US010040279B2

(12) United States Patent
Hiyoshi et al.

(10) Patent No.: US 10,040,279 B2
(45) Date of Patent: Aug. 7, 2018

(54) INK JET HEAD AND INK JET PRINTER

(71) Applicant: TOSHIBA TEC KABUSHIKI KAISHA, Tokyo (JP)

(72) Inventors: Teruyuki Hiyoshi, Izunokuni Shizuoka (JP); Noboru Nitta, Tagata Shizuoka (JP); Syunichi Ono, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/402,745

(22) Filed: Jan. 10, 2017

(65) Prior Publication Data

US 2017/0217162 A1 Aug. 3, 2017

(30) Foreign Application Priority Data

Jan. 29, 2016 (JP) ..... 2016-015754

(51) Int. Cl.
*B41J 29/38* (2006.01)
*B41J 2/045* (2006.01)
*B41J 2/14* (2006.01)

(52) U.S. Cl.
CPC ..... *B41J 2/04541* (2013.01); *B41J 2/0453* (2013.01); *B41J 2/04581* (2013.01); *B41J 2/14209* (2013.01)

(58) Field of Classification Search
USPC ..... 347/10, 11, 67, 68, 71
See application file for complete search history.

(56) References Cited

U.S. PATENT DOCUMENTS 5,666,144 A * 9/1997 Zhang ..... B41J 2/04581 310/333
5,767,871 A * 6/1998 Imai ..... B41J 2/04541 347/10
6,412,896 B2 * 7/2002 Takahashi ..... B41J 2/04508 347/10
6,951,376 B2 * 10/2005 Ishikawa ..... B41J 2/04531 347/102
8,057,002 B2 11/2011 Koseki et al.
8,926,042 B2 1/2015 Ono et al.
8,939,532 B2 1/2015 Ono et al.
9,028,025 B2 5/2015 Norigoe
9,079,393 B2 7/2015 Hiyoshi et al.
9,199,453 B2 12/2015 Ono et al.

* cited by examiner

*Primary Examiner* — Lam Nguyen
(74) *Attorney, Agent, or Firm* — Patterson & Sheridan, LLP

(57) ABSTRACT

An ink jet head includes first side walls including two piezoelectric elements, second side walls, a first electrode, a second electrode, an ink chamber containing conductive ink, and a control unit. The second side walls alternate with the first side walls to provide side surfaces for driving pressure chambers and dummy pressure chambers. On one of the first side walls, the first electrode is on the side wall surface of a driving pressure chamber and a second electrode is on the side wall surface of a dummy pressure chamber. The control unit applies a voltage having a first waveform to the first electrode, and a voltage having a second waveform, a portion of which is inverted with respect to the first waveform, to the second electrode to cause ink to be ejected, and cause the second electrode to electrically float such that ink is not ejected.

12 Claims, 6 Drawing Sheets

FIG. 4A
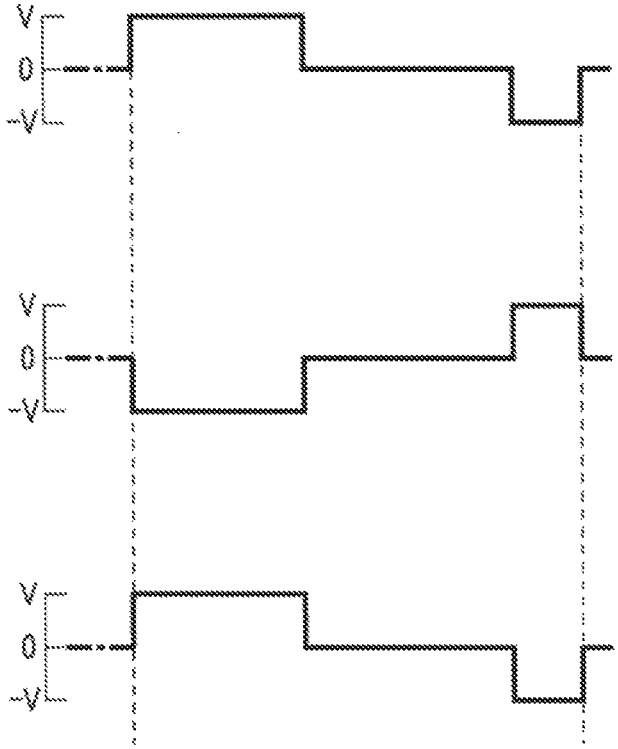
FIG. 4B
FIG. 4C
FIG. 5A
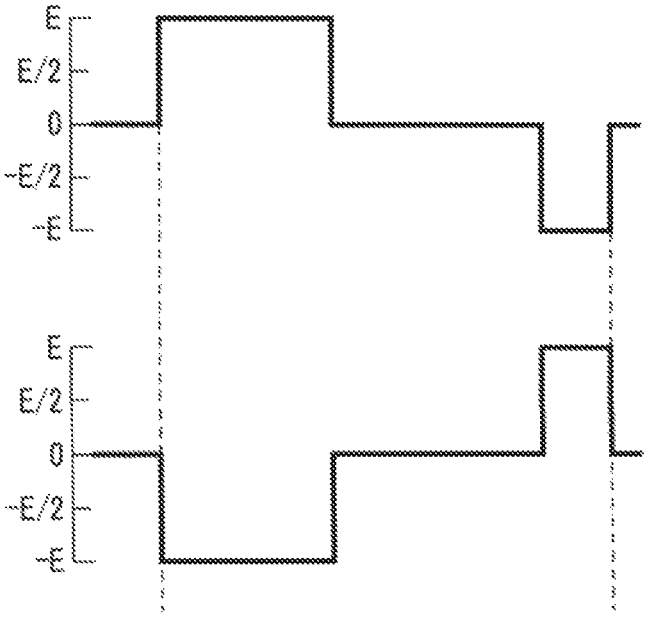
FIG. 5B

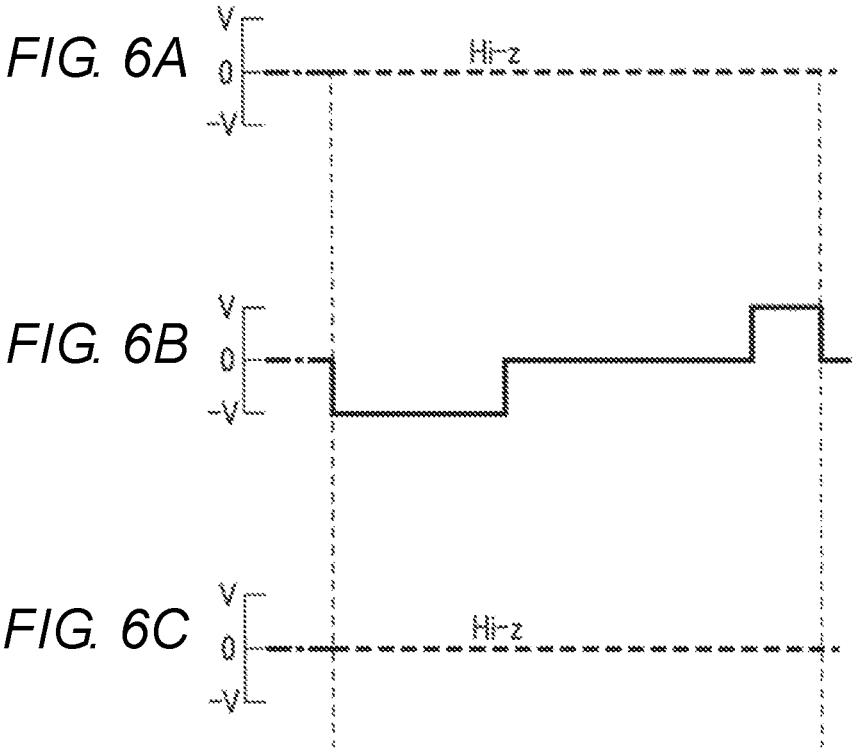
FIG. 6A
V
0
-V
Hi-z
FIG. 6B
V
0
-V
FIG. 6C
V
0
-V
Hi-z
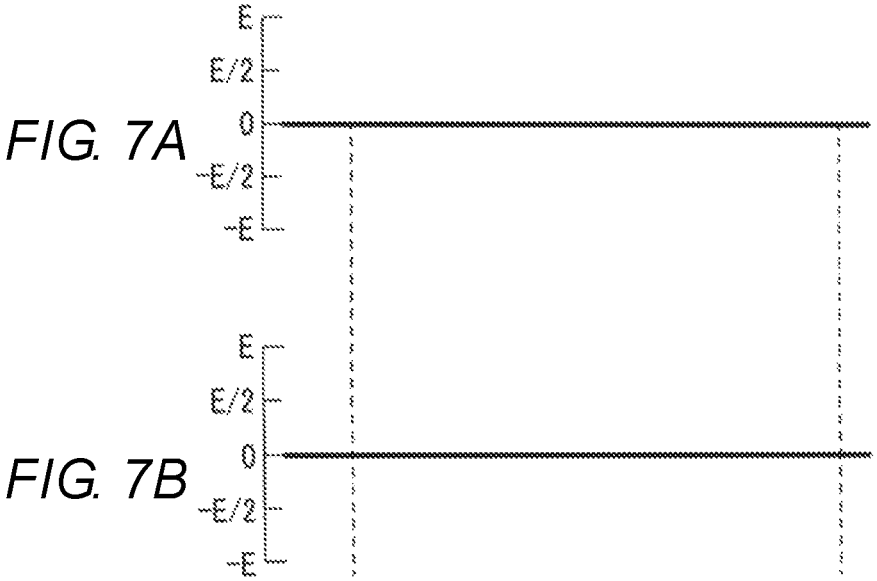
FIG. 7A
E
E/2
0
-E/2
-E
FIG. 7B
E
E/2
0
-E/2
-E

INK JET HEAD AND INK JET PRINTER

CROSS-REFERENCE TO RELATED APPLICATION

This application is based upon and claims the benefit of priority from Japanese Patent Application No. 2016-015754, filed Jan. 29, 2016, the entire contents of which are incorporated herein by reference.

FIELD

Embodiments described herein relate generally to an ink jet head and an ink jet printer.

BACKGROUND

There is an ink jet head which has a structure in which conductive ink is in direct contact with an electrode in a pressure chamber. In such ink jet head in which a conductive ink is in direct contact with an electrode, there is a case in which ink is electrolyzed due to a voltage applied to the electrode. When ink is electrolyzed, bubbles may be generated in the ink.

DESCRIPTION OF THE DRAWINGS

FIGS. 4A to 4C are diagrams which illustrate an example of a voltage waveform which is applied to an electrode according to the embodiment.

FIGS. 5A and 5B are diagrams which illustrate an example of a voltage waveform which is applied to a piezoelectric element according to the embodiment.

FIGS. 6A to 6C are diagrams which illustrate an example of a voltage waveform which is applied to an electrode according to the embodiment.

FIGS. 7A and 7B are diagrams which illustrate an example of a voltage waveform which is applied to the piezoelectric element according to the embodiment.

DETAILED DESCRIPTION

According to embodiments, there is provided an ink jet head and an ink jet printer which prevent conductive ink from being electrolyzed therein.

In general, according to one embodiment, an ink jet head includes a plurality of first side walls including at least two piezoelectric elements, a plurality of second side walls, a first electrode including at least two piezoelectric elements, a second electrode, an ink chamber, and a control unit. The second side walls alternate with the first side walls along a first direction, the first side walls providing first side surfaces and the second side walls providing second side surfaces for driving pressure chambers and dummy pressure chambers in an alternating manner, the driving pressure chambers and the dummy pressure chambers including a first driving pressure chamber and a first dummy pressure chamber that are formed from a common first wall and having a volume bound by opposed first and second side wall surfaces, a base surface and a top surface. The first electrode is on the base surface and the first side wall surface of the first driving pressure chamber. The second electrode is on the first side wall surface of the first dummy pressure chamber. An ink chamber contains conductive ink and is in fluid communication with the first driving pressure chamber. The control unit is configured to apply a first driving voltage pattern having a first waveform to the first electrode, and a second driving voltage pattern having a second waveform, at least a portion of which is inverted with respect to the first waveform, to the second electrode to cause ink to be ejected from or supplied into the first driving pressure chamber, and cause the second electrode to electrically float such that ink is not ejected from or supplied into the first driving pressure chamber.

Hereinafter, an embodiment will be described with reference to drawings.

An ink jet printer according to the embodiment forms an image on a printing medium by ejecting ink stored in an ink cartridge onto a printing medium (for example, a sheet). The ink jet printer applies a voltage to a piezoelectric element which forms a pressure chamber in the ink jet head to cause ink to be ejected from the pressure chamber.

Figure 1:
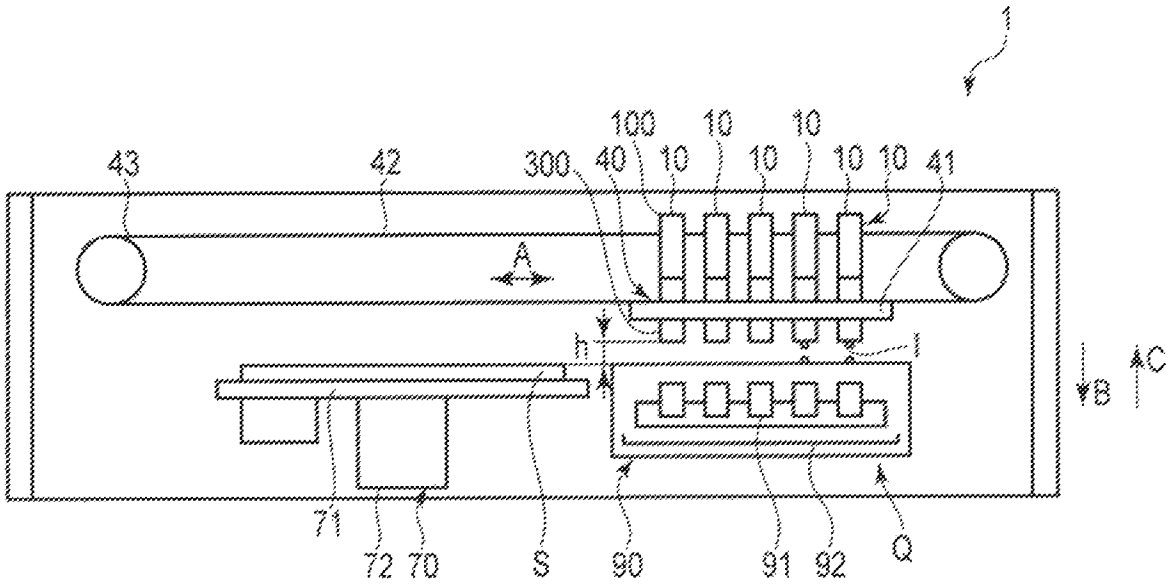
FIG. 1 is a diagram which illustrates a configuration example of an ink jet printer according to an embodiment.

FIG. 1 is a diagram which illustrates a configuration example of an ink jet printer 1.

The ink jet printer 1 includes a plurality of ink jet head units 10, and ink cartridges which correspond to the plurality of ink jet head units 10, respectively. In addition, the ink jet printer 1 includes a head support unit 40 which movably supports the plurality of ink jet head units 10, a printing medium moving unit 70 which movably supports a printing medium S, and a maintenance unit 90.

The ink jet head units 10 include an ink jet head 300 which is a liquid ejecting unit, and an ink circulating unit 100 which causes ink to be circulated.

Ink cartridges of each color communicate with the ink circulating unit 100 of a corresponding ink jet head unit 10, respectively, through a tube. Each ink cartridge supplies conductive ink to one of the ink jet head units 10. The conductive ink is ink containing a conductor such as water-based ink, or carbon, for example.

The head support unit 40 transports the ink jet head unit 10 to a predetermined position. For example, the head support unit 40 includes a carriage 41, a transport belt 42, and a carriage motor 43. The carriage 41 supports the plurality of ink jet head units 10. The transport belt 42 causes the carriage 41 connected thereto to reciprocate in the arrow A direction. The carriage motor 43 drives the transport belt.

The printing medium moving unit 70 (transport unit) includes a table 71 which fixes a printing medium S thereto by suction. The table 71 is attached to an upper portion of a sliding rail unit 72, and reciprocates in a direction (direction orthogonal to the plane surface of FIG. 1) which is orthogonal to both of arrows A and B. That is, the printing medium moving unit 70 causes the table 71 to reciprocate in a direction which is orthogonal to the carriage 41 direction of movement.

The maintenance unit 90 is arranged at a position within the scanning range of the plurality of ink jet head units 10 in the arrow A direction, a position which is outside of the movement range of the table 71. The maintenance unit 90 is a box shaped body of which the upper portion thereof is open, and is configured so as to move in a vertical direction (directions of arrows B and C in FIG. 1).

The maintenance unit 90 includes rubber blades 91 and a waste ink receiving unit 92. A separate portion of the blade 91 is provided for each nozzle plate, to remove ink, dust, paper dust, or the like, which has become attached to a nozzle plate of the ink jet head 300, of the ink jet head unit 10 of each color. The waste ink receiving unit 92 receives the ink, dust, paper dust, or the like, which is removed by the blade 91. The maintenance unit 90 includes a mechanism which moves the blade 91 in a direction orthogonal to the arrows A and B. The blade 91 thus wipes off a surface of the nozzle plate when the nozzle plates are located over the maintenance unit 90.

Hereinafter, the ink jet head 300 is described.

Figure 2:
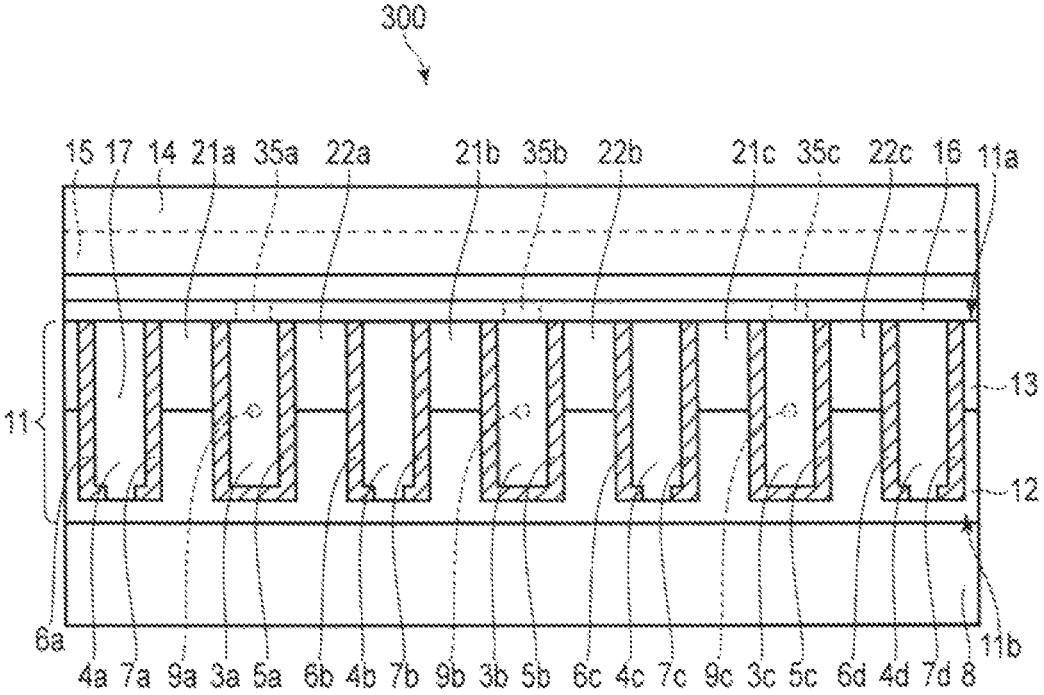
FIG. 2 is a diagram which illustrates an example of a sectional view of the inkjet head according to the embodiment.

FIG. 2 illustrates an example of a sectional view of the ink jet head 300.

The ink jet head 300 is a shear mode ink jet head of an end chute type. In addition, the ink jet head 300 is not limited to the shear mode ink jet head of the end chute type. The ink jet head 300 ejects ink therefrom onto a printing medium S which is secured on the printing medium moving unit 70 when the printing medium moving unit 70 is located under the ink jet head 300.

The ink jet head 300 includes a base portion 8, a piezoelectric member 11, a top board 14, a top plate 16, a nozzle plate 17, and a control unit 400 which will be described later herein. The ink jet head 300 further includes, for example, a cover, and a tube, or the like, which is connected to the ink cartridge.

The base portion 8 is a rectangular shaped plate member. The base portion forms a bottom surface of the ink jet head 300.

The piezoelectric member 11 is formed on the base portion 8. The piezoelectric member 11 is formed by bonding together a first piezoelectric element 12 and a second piezoelectric element 13. The first piezoelectric element 12 and the second piezoelectric element 13 are rectangular plate-shaped members. The first piezoelectric element 12 and the second piezoelectric element 13 are formed of, for example, lead zirconate titanate (PZT). Polarization directions of the first piezoelectric element 12 and the second piezoelectric element 13 are opposite to each other in the thickness direction thereof.

The piezoelectric member 11 includes a plurality of side walls 21 (first side walls) and a plurality of side walls 22 (second side walls). Lower portions of the side walls 21 and 22 are formed of the first piezoelectric element 12. Upper portions of the side walls 21 and 22 are formed of the second piezoelectric element 13. The side walls 21 and 22 have a structure extending in a direction orthogonal to the plane surface of the sheet of FIG. 2. The side walls 21 and 22 are alternately formed in a direction in which the side walls are aligned generally parallel to, and spaced from, one another.

The side walls 21 and 22 bound the sides of alternating driving pressure chambers 3 and dummy pressure chambers 4. The driving pressure chambers 3 and the dummy pressure chambers 4 are alternately formed in a direction in which the side walls are spaced apart, i.e., to the right and left in FIG. 2. As illustrated in FIG. 2, from the left hand to the right hand side of the ink jet head 300 as shown in FIG. 2, a dummy pressure chamber 4*a* is formed between, a location inwardly of the left end of the ink jet head 300 and a first side wall 21*a* of the ink jet head 300. A driving pressure chamber 3*a* is formed between, the first side wall 21*a* and a second side wall 22*a* of the ink jet head 300. Similarly, a dummy pressure chamber 4*b* is formed between, the second side wall 22*a* and a second first side wall 21*b*. A driving pressure chamber 3*b* is formed between the second first side wall 21*b* and a second second side wall 22*b*. A dummy pressure chamber 4*c* is formed between the second second side wall 22*b* and a third first side wall 21*c*. A driving pressure chamber 3*c* is formed between the third first side wall 21*c* and a third second side wall 22*c*.

The top plate 16 is formed on an upper surface 11*a* of the piezoelectric member 11 (top surface of side walls 21 and 22). The top plate 16 is formed in a rectangular shape, and covers at least a portion of the piezoelectric member 11.

The top plate 16 includes a plurality of opening portions 35 (shown in phantom as opening portions 35*a, b* and *c* in FIG. 2). Each of the opening portions 35 communicates with one driving pressure chamber 3. That is, a different opening portion 35*a, b* and *c* are formed on, and communicate with, each of the driving pressure chambers 3.

The top board 14 is provided over the top plate 16. The top board 14 is formed in a rectangular shape, and covers at least a portion of the top plate 16.

The top board 14 and the top plate 16 form a flow path 15 (common liquid chamber) therebetween (shown in phantom. The flow path 15 is formed over the plurality of opening portions 35. The flow path 15 communicates with the ink cartridge. Ink supplied from the ink cartridge flows into the flow path 15. In addition, the ink which flows into the flow path 15 flows into each of the driving pressure chambers 3 through each of the opening portions 35 of the top plate 16. That is, each of the driving pressure chambers 3 communicates with the flow path 15, and is filled with ink. Each of the dummy pressure chambers 4 is an isolated space, respectively, which is filled with air.

The nozzle plate 17 is formed on a front surface 11*b* of the piezoelectric member 11 over the ends of the plurality of first and second side walls 21, 22). The nozzle plate 17 includes a plurality of opening portions 9 extending therethrough. One of each of the opening portions 9 communicates with a different driving pressure chamber 3.

An electrode 5 (first electrode) is formed within each driving pressure chamber 3 on a side surface and a bottom surface thereof. The electrode 5 covers both of the side surfaces, and the bottom surface, of the driving pressure chamber 3.

Separate electrodes 6 and 7, which are spaced from one another, are formed in the dummy pressure chambers 4, one on each side surface thereof. The electrode 6 (second electrode) covers a first side surface of each dummy pressure chamber 4. The electrode 7 (second electrode) covers a second side surface of each dummy pressure chamber, and it faces the electrode 6 on the first side surface in each dummy pressure chamber 4.

Here, an electrode 7*a* of a dummy pressure chamber 4*a* is in contact with the first side wall 21*a* which forms a side of the driving pressure chamber 3*a*. An electrode 6*b* of a dummy pressure chamber 4*b* is in contact with the second side wall 22*a* which forms a side of the driving pressure chamber 3*a*. An electrode 7*b* of a dummy pressure chamber 4*b* is in contact with the second first side wall 21*b* which forms a side of the driving pressure chamber 3*b*. An electrode 6*c* of a dummy pressure chamber 4*c* is in contact with the second second side wall 22*b* which forms a wall of the driving pressure chamber 3*b*. An electrode 7*c* of a dummy pressure chamber 4*c* is in contact with the third first side wall 21*c* which forms a side of the driving pressure chamber 3*c*.

Hereinafter, the control unit 400 is described.

The control unit 400 applies a voltage to electrodes 5 to 7 based on printing data supplied from the outside. The side walls 21 and 22 which form the driving pressure chamber 3 are thus driven by a voltage from the control unit 400, which cause the side walls to deform. The control unit 400 thereby causes ink to be selectively ejected from the driving pressure chambers 3 through the opening portions 9, by controlling a voltage which is applied to the electrodes 5 to 7.

Figure 3:
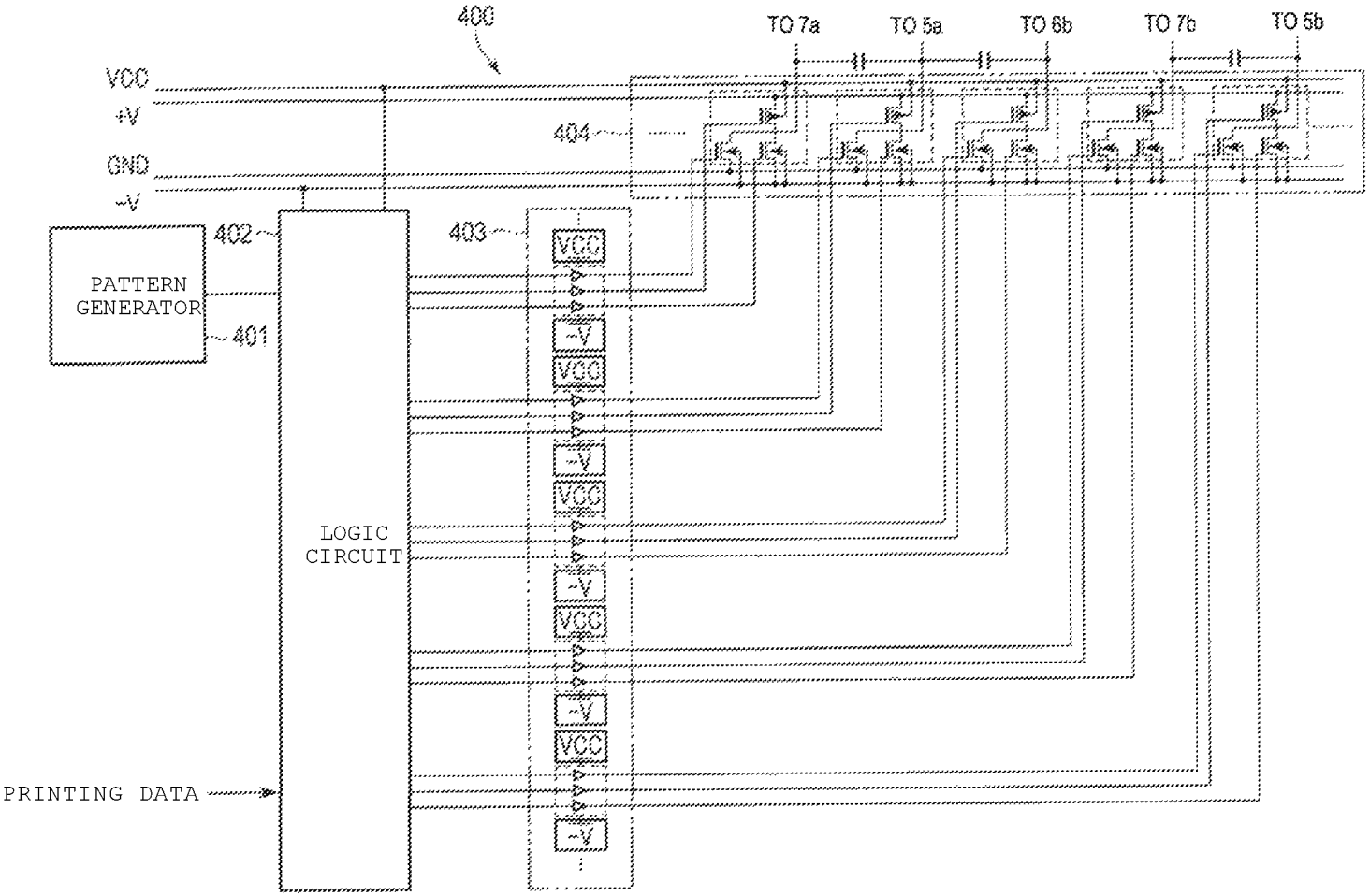
FIG. 3 is a diagram which illustrates a configuration example of a control unit of the ink jet head according to the embodiment.

FIG. 3 is a block diagram which illustrates a configuration example of the control unit 400.

As illustrated in FIG. 3, the control unit 400 includes a pattern generator 401, a logic circuit 402, a buffer circuit 403, a switch circuit 404, and the like.

The pattern generator 401 generates a waveform pattern driving voltage which causes ink to be ejected from driving pressure chambers 3. The waveform pattern in this embodiment is formed of a chamber expanding pulse, a chamber contracting pulse, and a zero voltage period therebetween. The expanding pulse causes the walls of a selected driving pressure chamber 3 to deform in a first direction and thereby causes the volume of the selected driving pressure chamber 3 to increase for a predetermined time. The contracting pulse provides a contracting pulse (or damping pulse) which causes the walls of the selected driving pressure deform in a second direction and thereby cause the volume of the selected driving pressure chamber 3 to be decrease for a predetermined time and thereby cause the ink therein to be ejected. The zero voltage period occurs in the time period between the expanding pulse and the contracting pulse. The positive or negative voltage of the expanding pulse and the contracting pulse are opposite to each other, i.e., one has a positive voltage, the other a negative voltage. A sum of the time period of application of the expanding pulse, the time of the zero voltage time period, and the time period of application of the contracting pulse provide a waveform for ejecting ink droplets of one drop, that is, they provide a duty cycle for ejection of one drop of ink.

The logic circuit 402 generates a driving voltage pattern for each electrode (electrode 5*a* . . . , electrode 6*a* . . . , and electrode 7*a* . . . ), based on printing data input from a bus line, and a waveform pattern which is generated in the pattern generator 401. The logic circuit 402 outputs a driving voltage pattern for each electrode to the buffer circuit 403.

The buffer circuit 403 buffers a driving voltage pattern which is output from the logic circuit 402. The buffer circuit 403 outputs the buffered driving voltage pattern to the switch circuit 404.

The switch circuit 404 outputs a driving voltage which is applied to each electrode, according to a driving voltage pattern for each electrode which is output from the buffer circuit 403.

The switch circuit 404 includes a plurality of groups of transistors configured to control the flow of current to each electrode 5, 6 and 7. The switch circuit 404 includes a circuit comprising a PMOS transistor, a NMOS transistor, and a NMOS transistor for each electrode. The PMOS transistor selectively connects an electrode to a voltage of V. The NMOS transistor selectively connects an electrode to ground (0 V) GND. The NMOS transistor selectively connects an electrode to a voltage of −V.

In the PMOS transistor which connects an electrode to a voltage of V, the source is connected to the voltage of V, the drain is connected to the electrode, the gate is connected to the buffer circuit 403, and the back gate is connected to a voltage of VCC. When the driving voltage pattern pulse is a voltage of −V, the PMOS transistor is turned on, and the voltage V is applied to the electrode. In addition, when a driving voltage pattern pulse has the voltage of VCC, the PMOS transistor is turned off, and the flow of current through the electrode is blocked.

In the NMOS transistor which connects the electrode to ground (the GND), the source is connected to the GND, the drain is connected to the electrode, the gate is connected to the buffer circuit 403, and the back gate is connected to the negative voltage of −V. When a driving voltage pattern pulse has the voltage of VCC, the NMOS transistor is turned on, and the electrode is at ground (GND). In addition, when a driving voltage pattern pulse has the voltage of −V, the NMOS transistor is turned off, and the flow of current through the electrode is blocked.

In the NMOS transistor which connects the electrode and the negative voltage of −V, the source is connected to the voltage of −V, the drain is connected to the electrode, the gate is connected to the buffer circuit 403, and the back gate is connected to the voltage of −V. When a driving voltage pattern pulse has the voltage of VCC, the NMOS transistor is turned on, and the electrode has the voltage of −V. In addition, when the driving voltage pattern has the voltage of −V, the NMOS transistor is turned on, and the flow of current through the electrode is blocked.

The switch circuit 404 controls the three transistors so that they are not turned on at the same time, and performs a control so that any one of the transistors is turned on, or all of the transistors are turned off.

Subsequently, a voltage applied to each electrode to cause a predetermined driving pressure chamber 3 to eject ink will be described.

FIGS. 4A to 4C illustrate examples of driving voltage patterns which are applied to each electrode when a selected one of the driving pressure chambers 3 ejects ink. FIGS. 4A to 4C illustrate driving voltage patterns which are applied to the electrode 5 of the selected driving pressure chamber 3, and a driving voltage which is applied to the electrode 6 of one of the dummy pressure chambers 4 adjacent to the selected driving pressure chamber 3, and to the electrode 7 of the other dummy pressure chamber 4 adjacent to the selected driving pressure chamber 3. For example, the electrodes receiving a driving voltage are 7*b*, 5*b* and 6*c*, such that the electrode of the pair of electrodes 6,7 in the adjacent dummy pressure chambers which are closest to the selected driving chamber 3, receive the driving voltage signal.

FIG. 4A illustrates the waveform of a driving voltage pattern applied to the electrode 7 (for the selected driving pressure chamber 3*b*, electrode 7*b* of the adjacent dummy pressure chamber 4*b*) which is in contact with the side wall 21 (in this case, side wall 21*b*) which bounds a side of the driving pressure chamber 3 (here, driving pressure chamber 3*b*). FIG. 4B illustrates the waveform of a driving voltage pattern applied to the electrode 5 of the driving pressure chamber 3, here driving pressure chamber 3*b*. FIG. 4C illustrates a waveform of a driving voltage pattern applied to the electrode 6 (here, electrode 6*c*) which is in contact with the side wall 22 (here side wall 22*b*) which bounds the other side of the driving pressure chamber 3 (here, driving pressure chamber 3*b*).

The control unit 400 applies a driving voltage (second driving voltage pattern) having the waveform illustrated in FIGS. 4A and 4C to the electrodes 6 and 7 which are on the shared walls between the selected driving pressure chamber 3 and the adjacent dummy pressure chambers 4 to either side thereof. When the second driving voltage pattern is applied, the control unit 400 first applies an expanding pulse, where the amplitude (y-axis) is the voltage of V, and the width (x-axis direction) is the pulse duration to provide a predetermined expanding time of the selected driving pressure chamber 3. The control unit 400 sets the voltage as zero (GND), after applying the expanding pulse. The control unit 400 then applies a contracting pulse, after a lapse of time in which the voltage is zero. The second driving voltage amplitude is the voltage of −V, and the width is a pulse duration to provide a predetermined contracting time.

The control unit 400 also applies a driving voltage pattern (first driving voltage) having the waveform illustrated in FIG. 4B to the electrode 5 of the selected driving pressure chamber 3. When the first driving voltage pattern is applied, the control unit 400 applies a voltage pulse of amplitude −V as an expanding pulse. The expanding pulse of the first driving voltage pattern has an amplitude of the voltage of −V, and a width having a pulse duration for a predetermined expanding time of the selected driving pressure chamber 3. The control unit 400 sets the voltage as zero (GND), after applying the expanding pulse. The control unit 400 then applies a contracting pulse, after a lapse of the time during which the voltage is set as zero. In the contracting pulse in the first driving voltage, the amplitude is the voltage of V, and the width is the pulse duration for a predetermined contracting time of the selected driving pressure chamber 3.

The waveform of the first driving voltage pattern illustrated in FIG. 4B is a reversed (inverse) waveform of the second driving voltage pattern illustrated in FIGS. 4A and 4C. In the inverse waveform, the positive bias portions and negative bias portions of the waveforms are inversed. The control unit 400 applies the second driving voltage pattern which is a reversed waveform of the first driving voltage which is applied to the electrode 5 of the selected driving pressure chamber 3 to adjacent electrodes 6 and 7. In addition, the waveform of the second driving voltage pattern may be a waveform obtained by reversing only a portion of the waveform of the first driving voltage pattern. The heights (amplitude of voltage) of an expanding pulse and a contracting pulse of the second driving voltage pattern may be the same as the heights (amplitude of voltage) of the expanding pulse and the contracting pulse of the first driving voltage pattern, or may be different from those heights.

Next, the voltage applied to the side walls 21 and 22 which bound opposed sides of the driving pressure chamber 3 is described.

FIGS. 5A and 5B illustrate an example of a voltage which is applied to the side walls 21 and 22.

FIG. 5A illustrates an example of a voltage which is applied to the side wall 21 (for example, side wall 21*b*) which bounds a portion of the driving pressure chamber 3 (for example, driving pressure chamber 3*b*). FIG. 5B illustrates an example of a voltage which is applied to the side wall 22 (for example, side wall 22*b*) which bounds a portion of the driving pressure chamber 3 (for example, driving pressure chamber 3*b*).

The voltage applied to the side walls 21 and 22 is the voltage difference between the electrode 5 voltage value and the electrodes 7 and 6 voltage value.

As illustrated in FIG. 5A, the difference between the voltage of the second expanding pulse applied to applied to the electrode 7 of the adjacent dummy pressure chamber 5 (FIG. 4A) and the voltage of the first expanding pulse applied to electrode 6 of the driving pressure chamber 5 (FIG. 4B) creates the expanding voltage pulse on the side wall 21 has an amplitude of a voltage of E, which twice the of voltage of V) is applied to the side wall 21. The voltage E returns to zero after applying the expanding pulse, as results from combining the zero voltage values of the first and second voltage patterns (FIGS. 4A and 4B) between the expanding and contracting pulses. After the passage of the time in which the voltage E is zero, a contracting pulse having an amplitude of voltage of −E is applied to the side wall 21, as results from the voltage difference between the contracting pulses of the first and second voltage patterns of FIGS. 4A and 4B.

As illustrated in FIG. 5B, an expanding pulse having a voltage amplitude of −E is applied to the side wall 22 provided by the differences between the expanding voltage value applied to electrode 5 of the driving pressure chamber 3 (FIG. 4*b*) and the electrode 6 of the adjacent dummy pressure chamber 5 (FIG. 4*c*). The voltage is returned to zero after applying the expanding pulse. After the passage of time in which the voltage is zero based on the same zero voltage, or ground (GND) potential being applied to both electrodes 5 and 6, a contracting pulse having a voltage amplitude of E is applied to the side wall 22, which is the difference between the contracting voltage value applied to electrode 5 of the driving pressure chamber 3 (FIG. 4*b*) and the electrode 6 of the adjacent dummy pressure chamber 5 (FIG. 4*c*).

Next, a voltage which is applied to each electrode when ink is not to be ejected from a predetermined driving pressure chamber 3 will be described.

FIGS. 6A to 6C illustrate examples of voltages which are applied to the electrodes when ink is not to be ejected from a predetermined driving pressure chamber 3. FIGS. 6A to 6C illustrate voltages which are applied to the electrode 5 of the driving pressure chamber 3 and to the electrodes 6 and 7 of the two adjacent dummy pressure chambers 4 which is adjacent to the driving pressure chamber 3. Again, the electrodes in the two dummy chambers, which are closest to the driving pressure chamber 3, have the voltages applied thereto.

FIG. 6A illustrates a voltage applied to the electrode 7 (for example, electrode 7*b*) which is in contact with the side wall 21 (for example, side wall 21*b*) which forms a side of the driving pressure chamber 3 (for example, driving pressure chamber 3*b*). FIG. 6B illustrates a voltage applied to the electrode 5 of the driving pressure chamber 3. FIG. 6C illustrates a voltage applied to the electrode 6 (for example, electrode 6*c*) which is in contact with the side wall 22 (for example, side wall 22*b*) which forms a side of the driving pressure chamber 3 (for example, driving pressure chamber 3*b*).

As illustrated in FIGS. 6A and 6C, the control unit 400 sets the electrodes 6 and 7 such that the flow of current therethrough is blocked and they are in an electrically floating state.

As illustrated in FIG. 6B, the control unit 400 applies the same voltage as that when ink is ejected from the driving pressure chamber 3 to the electrode 5 of the driving pressure chamber 3. That is, the control unit 400 applies the voltage of −V to the electrode 5 of the driving pressure chamber 3. The control unit 400 then sets the voltage applied to electrode 5 to zero (GND) once the voltage of −V has been applied for a predetermined time. The control unit 400 applies the voltage of V, after the passing of a period of time where the voltage was zero.

The resulting voltage applied to the side walls 21 and 22 which form the driving pressure chamber 3 is shown 7A and 7B.

FIG. 7A illustrates the voltage applied to the side wall 21 (for example, side wall 21*b*) which forms a side of the driving pressure chamber 3 (for example, driving pressure chamber 3*b*) when the voltage pattern of FIG. 6B is applied to electrode 5 of the selected driving pressure chamber 3 and the voltage pattern of FIG. 6A is applied to electrode 7 in the dummy pressure chamber 5 on one side thereof. FIG. 7B illustrates the voltage applied to the side wall 22 (for example, side wall 22*b*) which forms a side of the driving pressure chamber 3 (for example, driving pressure chamber 3*b*) when the voltage pattern of FIG. 6B is applied to electrode 5 of the selected driving pressure chamber 3 and the voltage pattern of FIG. 6C is applied to electrode 6 in the dummy pressure chamber 5 on the other side thereof.

Since current flow through the electrodes 6 and 7 adjacent to the driving pressure chamber 3 is blocked and the electrode is at a floating electric potential, there is no voltage difference between electrode 5 and electrode 7 or between electrode 5 and electrode 6, and as illustrated in FIGS. 7A and 7B, the voltage applied to the side walls 21 and 22 is zero.

Next, an operation example of the ink jet head 300 will be described.

Figure 8:
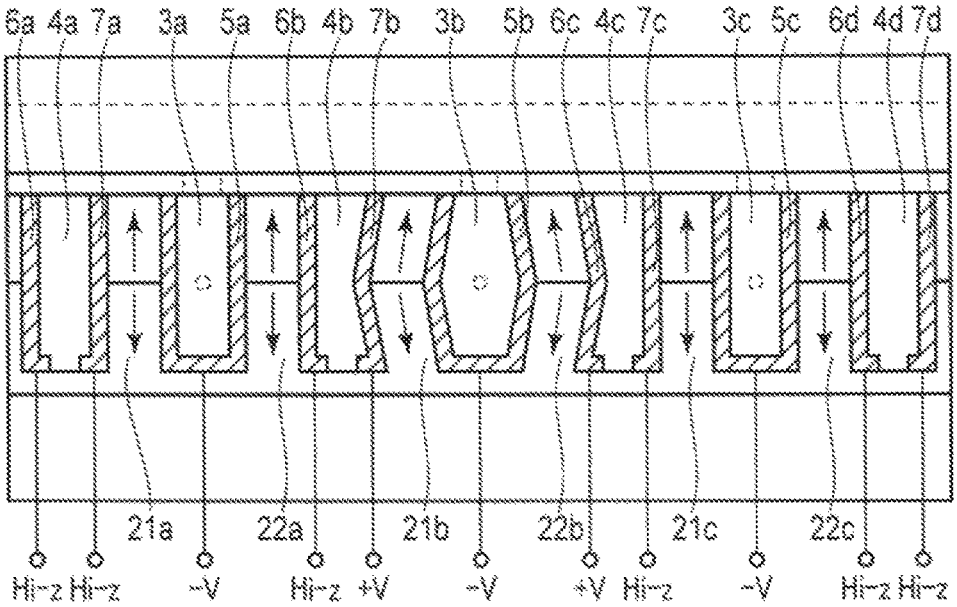
FIG. 8 is a sectional view which illustrates an operation example of the ink jet head according to the embodiment.

FIG. 8 illustrates an example of a sectional view of the ink jet head 300 when a volume of the driving pressure chamber 3 expands. That is, FIG. 8 illustrates a sectional view when an expanding voltage pulse is applied to each electrode.

Here, it is assumed that a volume of the driving pressure chamber 3*b* expands.

As illustrated in FIG. 8, the side walls 21*b* and 22*b* are bent in a direction (a direction in which each side wall expands away from the inner space of the driving pressure chamber 3) in which the volume of the driving pressure chamber 3*b* expands. By applying voltages of equal and opposite magnitudes of to the side walls of the driving pressure chamber 5, the walls expand in opposite direction by nearly equal amounts, in this case outwardly of their positions when no voltage is applied. As a result, the volume of the driving pressure chamber 3*b* increases.

After the period of time when the electrodes are grounded as shown in FIGS. 4A to 4C, the voltage of −V is applied to the electrode 5*b* of the driving pressure chamber 3*b*. At the same time, the voltage of −V is also applied to the electrodes 5 (for example, electrodes 5*a* and 5*c*) of the driving pressure chambers 3 (for example, driving pressure chambers 3*a* and 3*c*) of which a volume does not expand (that is, it does not draw in ink).

Accordingly, the same voltage (−V) is applied to the electrode 5 of the driving pressure chamber 3 in which the volume expands, and the electrode 5 of the driving pressure chambers 3 in which a volume does not expand.

Figure 9:
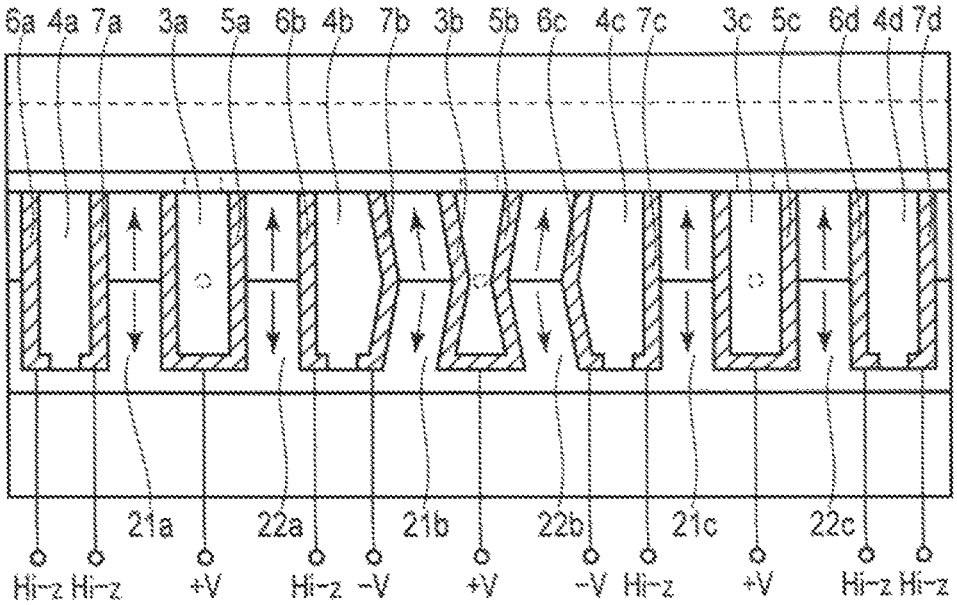
FIG. 9 is a sectional view which illustrates an operation example of the ink jet head according to the embodiment.

FIG. 9 illustrates an example of a sectional view of the inkjet head 300 when a volume of the driving pressure chamber 3 contracts. That is, FIG. 9 illustrates a sectional view when a contracting voltage pulse is applied to each electrode.

Here, the volume of the driving pressure chamber 3 contracts.

As illustrated in FIG. 9, the side walls 21*b* and 22*b* are bent in a direction (direction of being recessed inwardly of the position thereof when no voltage is applied) in which a volume of the driving pressure chamber 3*b* contracts. When the side walls 21*b* and 22*b* bend inwardly, the volume of the driving pressure chamber 3*b* decreases and ink therein is ejected to the sheet being printed on.

The voltage of V is applied to the electrode 5*b* of the driving pressure chamber 3*b*. Similarly, the voltage of V is also applied to the electrode 5 (for example, electrodes 5*a* and 5*c*) of the driving pressure chamber 3 (for example, driving pressure chambers 3*a* and 3*c*) of which a volume does not contract (that is, does not eject ink).

Accordingly, the same voltage (V) is applied to the electrode 5 of the driving pressure chamber 3 of which the volume thereof contracts, and the electrode 5 of the driving pressure chamber 3 of which the volume thereof does not contract.

In addition, during the time period between the expanding and contracting pulses, both of the electrode 5 of the driving pressure chamber 3 which ejects ink and the electrode 5 of the driving pressure chamber 3 which does not eject ink are at GND, or zero volts.

The ink jet head which is configured as described above applies the same voltage to the electrode in the driving pressure chamber which ejects ink, and the electrode of the driving pressure chamber which does not eject ink. As a result, there is no difference in potential between electrodes which are in contact with ink, and it is possible to prevent electrolysis of ink caused by current flowing between electrodes in the driving chambers of different voltage potentials.

The ink jet head applies a voltage which is obtained by inverting the voltage applied to the electrode of the driving pressure chamber to the electrode of the dummy pressure chamber, i.e., where one electrode has applied thereto a voltage value which is a positive potential, the other has a negative potential of the same amplitude applied thereto. As a result, in the ink jet head, it is possible to apply a voltage of two times that of the voltage applied to each electrode to the side wall on which the electrodes are located. Accordingly, it is possible to decrease the voltage applied to the electrode, in the ink jet head while maintaining desired expansion and contraction of the driving pressure chambers 3.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head comprising:

a plurality of first side walls including at least two piezoelectric elements;

a plurality of second side walls including at least two piezoelectric elements, wherein the second side walls alternate with the first side walls along a first direction, the first side walls providing first side surfaces and the second side walls providing second side surfaces for driving pressure chambers and dummy pressure chambers in an alternating manner, the driving pressure chambers and the dummy pressure chambers including a first driving pressure chamber and a first dummy pressure chamber that are formed from a common first wall and having a volume bound by opposed first and second side wall surfaces, a base surface and a top surface;

a first electrode on the base surface and the first side wall surface of the first driving pressure chamber;

a second electrode on the first side wall surface of the first dummy pressure chamber;

an ink chamber containing conductive ink and in fluid communication with the first driving pressure chamber; and a control unit configured to apply a first driving voltage pattern having a first waveform to the first electrode, and a second driving voltage pattern having a second waveform to the second electrode, such that at least a portion of the second waveform is inverted with respect to the first waveform when the ink is ejected from or supplied into the first driving pressure chamber, and the second electrode is in an electrically floating state when the ink is not ejected from or supplied into the first driving pressure chamber.

2. The ink jet head according to claim 1, wherein the second waveform of the second driving voltage pattern is an inverse waveform of the full waveform of the first driving voltage pattern.

3. The ink jet head according to claim 1, wherein the first driving voltage pattern includes an expanding pulse which expands the volume of the first driving pressure chamber, and a contracting pulse which contracts the volume of the first driving pressure chamber.

4. The ink jet head of claim 3, wherein the expanding pulse of the first driving voltage pattern which expands the volume of the first driving pressure chamber causes ink to be supplied into the first driving pressure chamber, and the contracting pulse which contracts the volume of the first driving pressure chamber causes ink to be ejected from the first driving process chamber.

5. The head according to claim 1, wherein the conductive ink is water-based ink.

6. The ink jet head of claim 1, wherein each of the driving pressure chambers include the first electrode and the first electrodes in the driving pressure chambers are electrically connected to be at the same voltage potential.

7. An ink jet printer comprising a transport unit configured to transport a printing medium on which an image is formed using conductive ink, and ink jet head configured to eject the conductive ink onto the printing medium, wherein the ink jet head includes:

a plurality of first side walls including at least two piezoelectric elements;

a plurality of second side walls including at least two piezoelectric elements, wherein the second side walls alternate with the first side walls along a first direction, the first side walls providing first side surfaces and the second side walls providing second side surfaces for driving pressure chambers and dummy pressure chambers in an alternating manner, the driving pressure chambers and the dummy pressure chambers including a first driving pressure chamber and a first dummy pressure chamber that are formed from a common first wall and having a volume bound by opposed first and second side wall surfaces, a base surface and a top surface;

a first electrode on the base surface and the first side wall surface of the first driving pressure chamber;

a second electrode on the first side wall surface of the first dummy pressure chamber;

an ink chamber containing conductive ink and in fluid communication with the first driving pressure chamber; and a control unit configured to apply a first driving voltage pattern having a first waveform to the first electrode, and a second driving voltage pattern having a second waveform to the second electrode, such that at least a portion of the second waveform is inverted with respect to the first waveform, when the ink is ejected from or supplied into the first driving pressure chamber, and the second electrode is in an electrically floating state when the ink is not ejected from or supplied into the first driving pressure chamber.

8. The ink jet printer according to claim 7, wherein the second waveform of the second driving voltage pattern is obtained of an inverse waveform of the waveform of the first driving voltage pattern.

9. The ink jet printer according to claim 7, wherein the first driving voltage pattern includes an expanding pulse which expands the volume of the first driving pressure chamber, and a contracting pulse which contracts the volume of the first driving pressure chamber.

10. The ink jet printer of claim 9, wherein the expanding pulse of the first driving voltage pattern which expands the volume of the first driving pressure chamber causes ink to be supplied into the first driving pressure chamber, and the contracting pulse which contracts the volume of the first driving pressure chamber causes ink to be ejected from the first driving process chamber.

11. The ink jet printer according to claim 7, wherein the conductive ink is water-based ink.

12. The ink jet head of claim 7, wherein each of the driving pressure chambers include the first electrode and the first electrodes in the driving pressure chambers are electrically connected to be at the same voltage potential.

* * * * *